United States Patent [19]

Goncalves et al.

[11] Patent Number: 4,811,726

[45] Date of Patent: Mar. 14, 1989

[54] DEVICE FOR MANUALLY MASSAGING THE CUTANEOUS COVERING

[75] Inventors: Antonin Goncalves, Groslay; Philippe Osmond, Aulnay-la-Riviere, both of France

[73] Assignee: L'Oreal, Paris, France

[21] Appl. No.: 199,059

[22] Filed: May 26, 1988

Related U.S. Application Data

[62] Division of Ser. No. 73,254, Jul. 14, 1987.

[30] Foreign Application Priority Data

Jul. 21, 1986 [FR] France ..... 86 10531
Sep. 10, 1986 [FR] France ..... 86 12653

[51] Int. Cl.[4] ..... A61H 15/00; B67D 3/00

[52] U.S. Cl. ..... 128/57; 222/521; 401/28; 401/209; 401/213; 401/219

[58] Field of Search ..... 428/24.3, 24.4, 57, 428/56, 67; 222/520, 521; 401/28, 208, 209, 213, 219, 277

[56] References Cited

U.S. PATENT DOCUMENTS

Re. 30,500 2/1981 Springer et al. ..... 128/57
2,103,261 12/1937 Hughes ..... 128/57
2,285,105 6/1942 Laszlo ..... 128/56
3,278,096 10/1966 Miller ..... 222/521
3,578,223 5/1971 Armour ..... 222/521
4,690,304 9/1987 Morel ..... 222/44

FOREIGN PATENT DOCUMENTS 2440735 6/1980 France .
0295252 12/1953 Switzerland .

*Primary Examiner*—Edgar S. Burr
*Assistant Examiner*—Huong Q. Pham
*Attorney, Agent, or Firm*—Cushman, Darby & Cushman

[57] ABSTRACT

A device for a massage of the cutaneous covering comprises a reservoir and an applicator element, and an obturator situated between them. This obturator comprises two parts, the first, or movable part being provided with a central stud and at least one opening to allow the product to be applied to pass through this first part, and the second or actuating part comprising a disc provided with a central hole and extended by a lower skirt covering at least the movable part. The applicator element is fixed to said actuating part. The two parts constituting the obturator comprise means cooperating with each other to ensure their relative displacement. The device can be used in the field of cosmetics.

10 Claims, 3 Drawing Sheets

DEVICE FOR MANUALLY MASSAGING THE CUTANEOUS COVERING

This is a division of application Ser. No. 073,254 filed July 14, 1987.

FIELD OF THE INVENTION

The present invention relates to a device for the manual massage of the cutaneous covering which can also be used for simultaneously applying a liquid or pasty product thereto.

PRIOR ART

To apply cosmetic products, such as deodorants for example, it may be advantageous to use applicators with a reservoir whose dispensing element is constituted by a ball: which has one side in contact with the product contained in the reservoir and the other in contact with the skin, so that by causing this ball to roll on the skin, the zone of this ball previously covered with the treatment products comes to be applied against the cutaneous covering. Such an applicator has a twofold advantage, both (i) that of allowing easy dispensing of a product in the form of a cream, or having a pasty consistency and (ii) that of avoiding any risk of injury or lesions of the skin during the handling of the applicators by the very reason of the rounded shape of the ball.

An example of such an apparatus, is described in FR-A-2440735 relating to a device comprising a reservoir which contains the product to be applied, and at least one applicator element mounted on a support and constituted by a spherical ball held in a housing, the internal space of this housing communicating with that of the reservoir by way of at least one opening. The or each such opening communicates with the reservoir by means of an obturator provided with at least one hole, the obturator and the support of the at least one applicator element constituting two parts, of which one is fixed in position and fastened to the reservoir and the other is movable and displaceable by the user in relation to the fixed par. The displacement of the movable part relative to the fixed part makes it possible to interrupt or to adjust the quantity of the treatment product(s) penetrating via the at least one opening inside the housing (or housings).

Such a device makes it, in effect, possible to massage the cutaneous covering while simultaneously applying a treatment product thereto. Although it is possible to adjust the quantity of the treatment product which penetrates through the openings inside the housings, and which is thus applied to the cutaneous covering, this adjustment is not completely satisfactory because the openings can be partly blocked by deposits of the product. Moreover, the cleaning of this prior art device requires a complete dismantling of the various parts which may, in time, prevent proper operation of the various parts which are movable in relation to each other.

OBJECTS OF THE INVENTION

Accordingly it is an object of the present invention to provide a device which allows a simultaneous massage and application of a product and which does not have the drawbacks of the prior art.

It is another object of the present invention to allow an effective and constant regulation of the quantity of the treatment product covering the balls, as well as easy cleaning which can in no way damage the parts susceptible to a relative motion.

It is yet another object of the invention to provide a device of this kind which makes it possible, moreover, to dose the quantity of the product applied to the cutaneous covering.

It is an additional object of the invention to provide such a device which would be easy and economical to manufacture.

SUMMARY OF THE INVENTION

These objects, as well as others which will become apparent below, are attained by a device for manual massaging of the cutaneous covering which can be used for the simultaneous application thereto of a liquid or pasty product, this device comprising firstly a reservoir containing the product to be applied and secondly, an applicator element which comprises at least one spherical ball held in a housing, the said housing having at least one opening on the side nearer the reservoir, so that its internal volume should be supplied by the reservoir with the product to be applied, and thirdly, an obturator situated between the reservoir and the applicator element, characterised in that the said obturator comprises two parts, the first or movable part being provided with a central stud and at least one opening to allow the product to be applied to pass through this first part, and the second or actuating part comprising a disc which is provided with a central hole and is extended by a lower skirt covering at least the movable part, the applicator element being fixed to said actuating part and being detachable in relation to this actuating part, these two parts constituting the obturator comprising means cooperating with each other to ensure their relative displacement in such a way that in a first or closed position, the central stud blocks the central hole, whilst in a second or open position the central hole is completely freed, the passing from the one position to the other being continuous.

Preferably, the reservoir comprises a neck whereon the actuating second part of the obturator is fixed; at the base of the said neck is a stop, and the lower skirt of the actuating second part comprises a projection; there is a cap able to be fitted on the neck and provided with a slot which cooperates with the projection and stop, when the obturator is in the closed position.

Advantageously, the neck, the obturator and the support (i.e. the applicator element) have a circular coaxial cross-section; the cap comprises on the one hand a circular internal skirt able to be fitted on the lateral wall of the neck while the slot of the cap is on the internal skirt, and on the other hand an external skirt of the same shape as the reservoir joined to the internal one by a top panel of the cap.

Preferably, the lower skirt of the actuating second part of the obturator comprises on its internal face at least one ramp cooperating with at least one lug of the movable first part of the obturator, the movable first part being guided in translation relative to the reservoir. In a preferred embodiment, this lower skirt of the actuating second part comprises three said ramps cooperating with three said lugs carried by the movable first part.

Advantageously, the movable first part of the obturator comprises an annulus delimiting a first annular opening between this annulus and the edge of the movable first part, and a second annular opening between this annulus and the central stud.

Preferably, the neck comprises at its base a groove which receives a circular bead on the internal edge of the lower skirt of the actuating second part of the obturator.

In order to limit the travel of the actuating second part, the annulus of the movable first part of the obturator may comprise a stop cooperating with a finger carried by the adjacent face of the disc of the actuating second part. Moreover, to prevent the first annular opening from being subject to clogging, the disc of the actuating second part can be provided with an annular cutter disposed on its face opposite the movable first part of the obturator.

The applicator element may comprise a central ball held in a housing whose bottom is open, and peripheral balls regularly disposed along a circle around the central ball, each peripheral ball housing being open towards the reservoir at its base and in its lateral surface.

In a variant, the reservoir of the device is constituted by a shell which is closed at one end by a bottom which is integral with a detachable container, this container being closed by a rupturable cover and containing the product to be applied, the free edge of the other end of the shell cooperating with the applicator element and the obturator, the obturator comprising means for rupturing the cover. This shell is preferably cylindrical.

Advantageously, this cylindrical shell comprises, at its end closed by the integral bottom of the detachable container, a fitting which is substantially coaxial with this shell and is directed towards the interior of the device and whose wall comprises an internal thread cooperating with an external thread on the container, this fitting being joined to the cylindrical shell by an annulus.

The means for rupturing the cover are preferably carried by the movable part of the obturator. This movable part also comprises a central opening delimited by a skirt integral with the edge of this part.

Advantageously the means for rupturing the cover are integral with the skirt and are preferably constituted by a star-shaped perforator whose axis forms at one end the central stud and at the other end a perforator tip.

Preferably the bottom of the detachable container projects therefrom in a circular zone which bears on the annulus, when the container is entirely screwed down into the fitting. This circular zone preferably comprises a sealing skirt cooperating with the internal wall of the fitting.

The present invention also provides a refill constituted by said detachable container for the variant device defined above. This container is cylindrical and comprises at one end a thread on its external wall and a bottom and at its other end, a rupturable cover.

BRIEF DESCRIPTION OF THE DRAWINGS

The description which follows is not intended to be in any way restrictive of the invention and should be read in conjunction with the accompanying drawings, in which.

DESCRIPTION OF THE PREFERRED EMBODIMENTS

Figure 1:
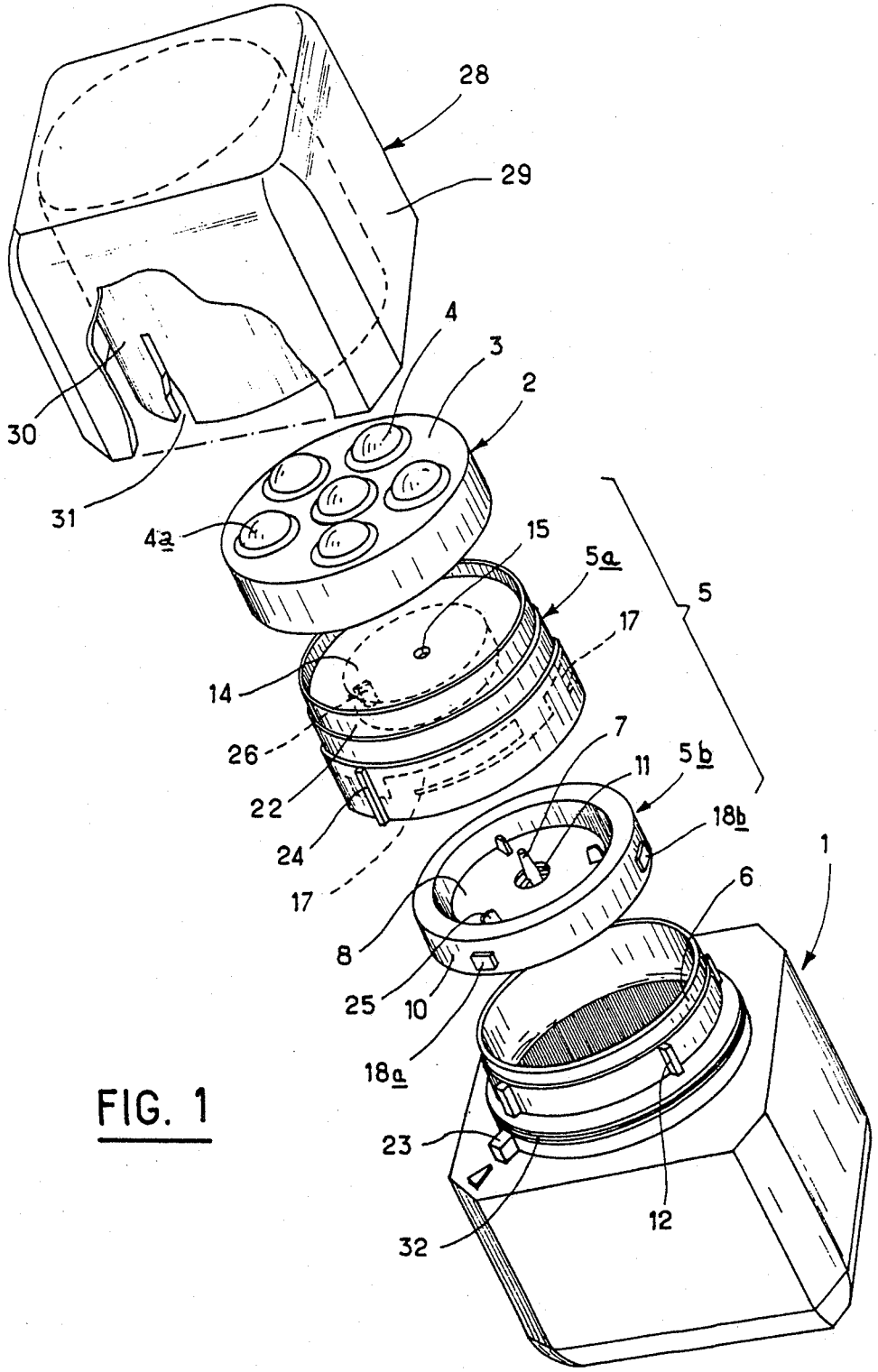
FIG. 1 is an exploded perspective of the various elements constituting a manual massaging device in accordance with the present invention.

As may be seen in these drawings, a device according to the invention for manual massaging of the cutaneous covering, which can be used for the simultaneous application thereon of a liquid or pasty product, comprises a reservoir 1 which contains the product to be applied and an applicator element, designated in its entirety by 2, comprising several spherical balls held in housings. This device also comprises an obturator 5 situated between the reservoir 1 and the applicator element 2.

In accordance with the invention, this obturator 5 comprises two parts: an actuating part **5*a* and a movable part 5*b***.

The reservoir 1 comprises a neck 6 whereon the actuating part **5*a* of the obturator 5 is fixed. The movable part 5*b* is provided with a central stud 7 and comprises an annulus 8, a first annular opening 9 being delimited between this annulus 8 and the edge 10 of the movable part 5*b*; a second annular opening 11 is delimited between this annulus 8 and the central stud 7. Thus the movable part 5*b* comprises two annular openings allowing the product contained in the reservoir 1** to pass through it.

Figure 3:
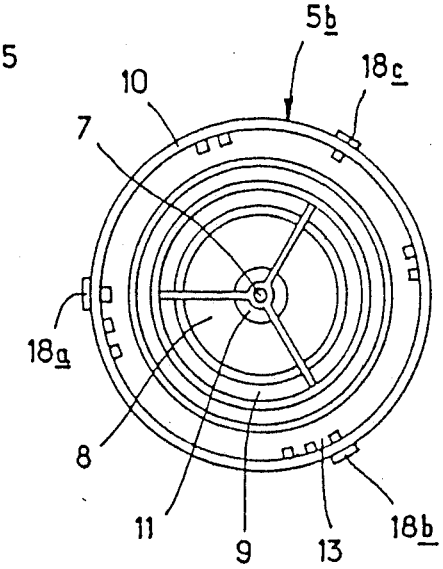
FIG. 3 is a view along line III—III of FIG. 2.

The external surface of the neck 6 comprises four ribs 12 extending parallel to the axis of the reservoir 1 and cooperating with grooves 13 (FIG. 3) on the internal face of the edge 10 of the movable part **5*b*. Thus, the movable part 5*b* of the obturator 5 is held fixed for rotation in relation to the neck 6 and is capable of a guided translation along the axis of neck 6. The edge 10 has a channel-shaped cross-section and comes to surmount the lateral wall of the neck 6 so that, at the end of travel, the web of the channel bears on the free end of the neck 6**.

The actuating part **5*a* of the obturator 5 comprises a disc 14 provided with a central hole 15 and extended by a lower skirt 16 which covers the movable part 5*b***.

Figure 2:
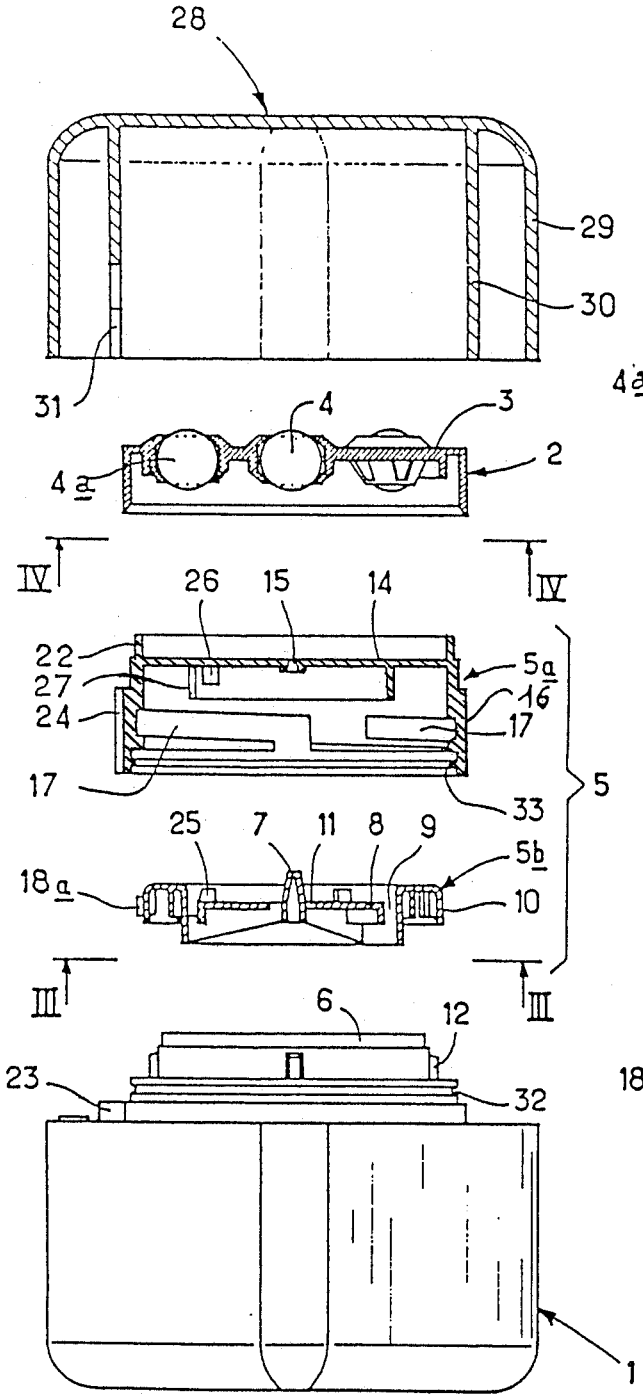
FIG. 2 represents an axial cross-section of the device of FIG. 1, the reservoir however not being shown in cross-section.
Figure 4:
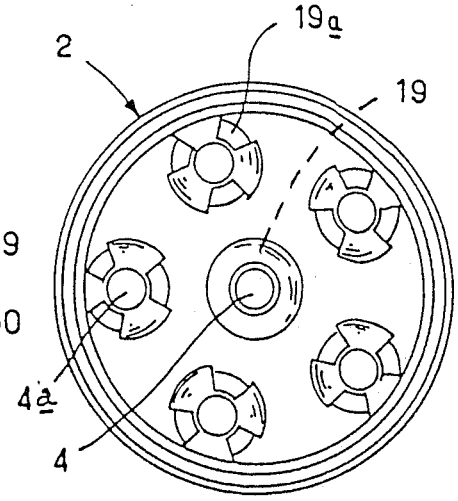
FIG. 4 is a view from below along line IV—IV of FIG. 2.

At the base of the neck 6, is an annular groove 32 cooperating with an annular bead 33 (FIG. 2) on the lower portion of the skirt 16 of the actuating part **5*a*, thus holding the actuating part 5*a* fixed in translation with the neck 6**, but able to turn in relation thereto.

The lower skirt 16 (FIG. 2) comprises on its internal face three helical ramps 17 cooperating with three lugs **18*a*, 18*b*, 18*c* carried by the external face of the edge 10 of the movable part 5*b*. When the user rotates the actuating part 5*a* the movable part 5*b* rises or descends in relation to the actuating part, because the lugs 18*a*, 18*b*, 18*c* each follow one of the ramps 17. Because of this, the stud 7 penetrates to a greater or lesser extent into the hole 15. When the movable part 5*b* is nearest the disc 14, the central stud 7 completely blocks the central hole 15; on the other hand, when the lugs 18*a*, 18*b*, 18*c* are at the lower portion of the ramps 17, the movable part 5*b* is then remote from the disc 14 so that the central stud 7 no longer penetrates into the central hole 15 which is thus fully open. Passing from the first position or closed position to the second position or open position is a continuous process, that is to say, the central hole 15 is, to a greater or lesser extent, closed by the central stud 7 depending on the rotational position of the actuating part 5*a* in relation to the reservoir 1. This structure thus makes it possible to let the desired flow of the product pass through the central hole 15**.

The neck 6, the obturator 5 and the applicator element 2 are, in this embodiment, coaxial cylindrical elements with a circular cross-section. The applicator element 2 is nestingly fixed to the upper part 22 of the actuating part 5*a*. The applicator element 2 comprises a support 3 on which are disposed a central ball 4 and five peripheral balls 4*a* which are regularly distributed along an annulus around the central ball 4. Each ball 4 or 4*a* is held in a housing 19 or 19*a* respectively, which comprises at least one opening in its bottom, so that the internal space of this housing will be supplied with the product contained in the reservoir 1, the bottom of this housing 19 or 19*a* being the portion thereof which is nearest to the disc 14. The housing 19 of the central ball 4 is only open at its bottom; on the other hand, the housings 19*a* of the peripheral balls 4*a* each comprise an opening in their bottom and also three lateral openings.

When the device according to the present invention is in the fully or partly open position, the product to be applied passes from the reservoir 1 as far as the balls 4, 4*a* by passing through the first and second annular openings 9 and 11 of the movable part 5*b* and through the central hole 15 of the actuating part 5*a*. This product then runs onto the base of the housings 19 and 19*a* of the balls 4 and 4*a* in the space delimited between the part 5*a* and the applicator element 2. This space performs the function of an intermediate reservoir. The product to be applied comes into contact with the balls 4, 4*a* through the openings of their housings 19, 19*a*.

As will have been understood, the cleaning of this device is limited to cleaning the support 3 and that of the face of the disc 14 opposite the support 3, this face being within easy reach by simply disconnecting the connection between the applicator element 2 and the actuating part 5*a*.

At the base of the neck 6 of reservoir 1, is a stop 23; there is also a projection 24 carried by the external face of the actuating part 5*a*. Alignment of this projection 24 and this stop 23 gives rise to the maximum depression of the stud 7 in the hole 15, this corresponding to the closed position of the obturator.

The device according to the present invention also comprises a cap 28 which rests on the reservoir 1 and protects the balls 4, 4*a* of the applicator element 2. This cap comprises an external skirt 29, whose shape is identical with that of the reservoir so as to form therewith an attractive unit, and a cylindrical internal skirt 30, the two skirts being joined by the top panel of the cap. The internal cylindrical skirt 30 comprises a slot 31 parallel to the axis of the cap 28 and able to surmount both the vertical external projection 24 on the actuating part 5*a*, and also the stop 23, when the obturator is in the closed position. Unless the projection 24 and stop 23 are aligned, it is not possible to fit the cap 28 on the reservoir 1.

The annulus 8 comprises a stop 25 cooperating with a finger 26 carried by the adjacent face of the disc 14. There is thus obtained a limitation of the rotational actuating travel of the obturator part 5*a*.

On the disc 14, opposite the movable part 5*b*, is an annular cutter 27 cooperating with the first annular opening 9 of the part 5*b*: in the closed position of the obturator 5, this annular cutter 27 penetrates into the first annular opening 9 and thus makes it possible to prevent any clogging due to the drying out of the product.

Figure 5:
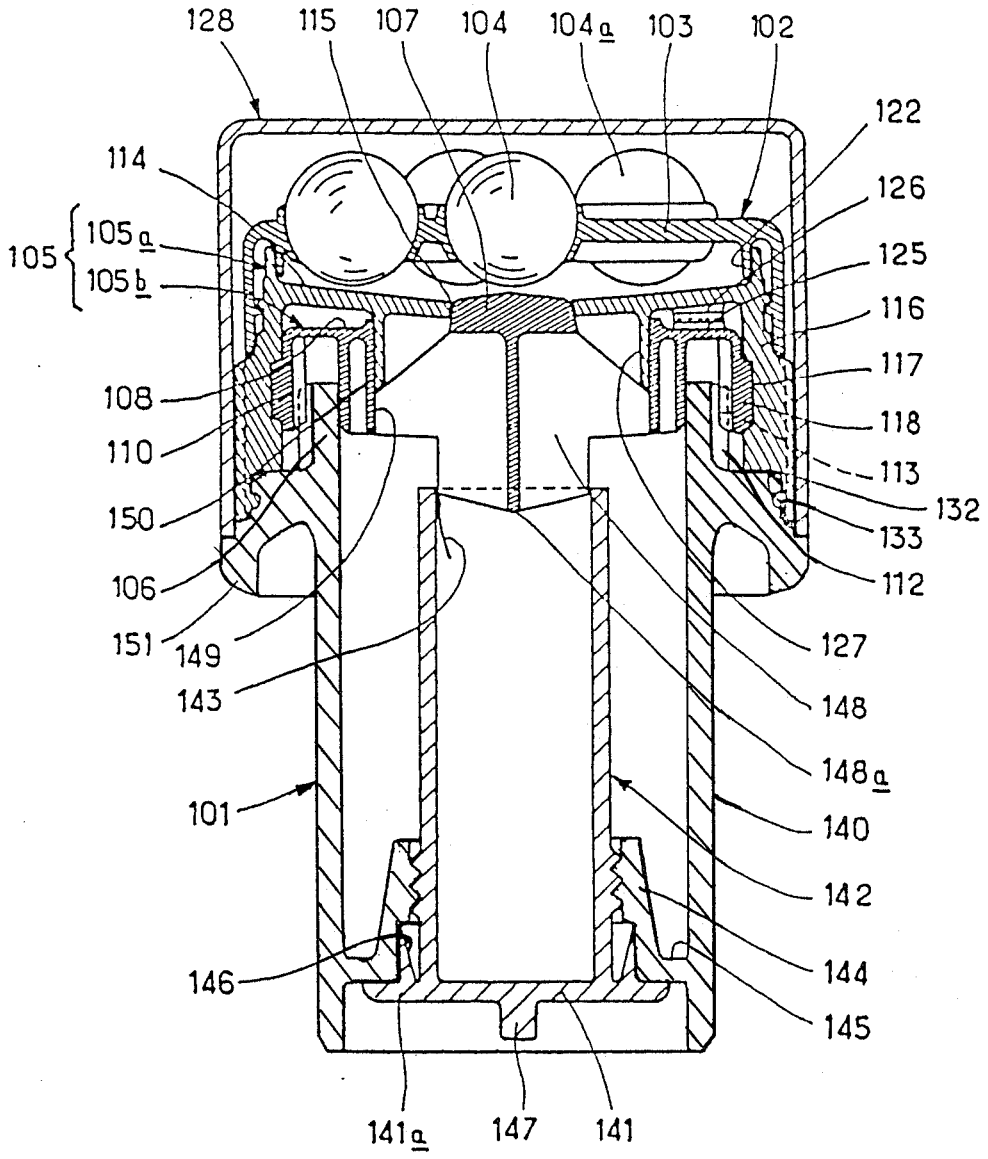
FIG. 5 represents an axial cross-section of a variant of the embodiment of the present invention.

In a variant of the device, represented in FIG. 5, the reservoir designated in its entirety by the reference numeral 101 contains the product to be applied and has an applicator element, generally designated by the reference numeral 102, comprising several spherical balls held in housings. This device also comprises an obturator 105 situated between the reservoir 101 and the applicator element 102. This obturator 105 comprises two parts, namely an actuating part 105*a*, and a movable part 105*b*.

The applicator element 102 comprises a support 103 carrying a central ball 104 and five peripheral balls 104*a*, which are regularly distributed along a circle concentrically around the central ball 104. Each ball 104, 104*a* is held in a housing which comprises at least one opening in its bottom, so that the internal volume of this housing should be supplied with the product contained in the reservoir 101.

In the present variant, the reservoir 101 is constituted by a cylindrical shell 140 which is coaxial with the obturator 105 and the applicator element 102. This cylindrical shell is closed at one end by a bottom 141 integral with a detachable container 142 which is closed by a rupturable cover 143 and contains the product to be applied. The other end of the cylindrical shell 140 constitutes an edge 106 forming a neck. The cylindrical shell 140 comprises towards its free edge 106, an annular rim 151.

The actuating part 105*a* comprises a disc 114 provided with a central opening 115 and extended by a lower skirt 116 which covers the movable part 105*b*. The internal edge of this lower skirt 116 comprises a circular bead 133 which is received in an external groove 132 of the annular rim 151. This actuating part 105*a* is thus integrated with the annular rim 151 of the cylindrical shell 140, but can turn in relation thereto, and therefore in relation to the neck 106.

The movable part 105*b* of the obturator 105 comprises an edge 110 which has a channel-shaped cross-section and surmounts the free end of the neck 106. It also comprises (i) a central stud 107 which can, to a variable extent, block the central hole 115 of the actuating part 105*a*, and (ii) a central opening 149 to be described below.

The external surface of the neck 106 comprises four ribs, parallel to the axis of the reservoir 101, which cooperate with grooves 113 disposed on the internal face of the edge 110 of the movable part 105*b*; thus the movable part 105*b* of the obturator 105 is held fixed for rotation relative to the neck 106 and is capable of a guided translation along the axis of the neck 106. At the end of the travel, the web of the channel constituting the edge 110 can bear on the free end of the neck 106.

The lower skirt 116 comprises on its internal face three helical ramps 117 cooperating with three lugs carried by the lateral face of the edge 118 of the movable part 105*b*. When the user manually rotates the actuating part 105*a* the movable part 105*b* rises or descends relative to the actuating part, because the lugs 118 each follow one of the ramps 117. Because of this, the stud 107 penetrates to a greater or lesser extent into the hole 115. When the movable part 105*b* is then nearest the disc 114, the central stud 107 entirely blocks the central hole 115; on the other hand, when the lugs 118 are at the lower portion of the ramps 117, the movable part 105*b* is then remote from the disc 114, so that the central stud 107 no longer penetrates into the central hole 115 which is thus completely open. Passing from the first or closed position to the second or open position is a continuous process, that is to say, there is a continuous progressive closing or opening of the central hole 115 by the central stud 107 depending on the rotational position of the actuating part 105*a* in relation to the reservoir 101. This structure thus allows the desired flow of the product to pass through the central hole 115.

As has been stated above, the movable part 105*b* comprises a central opening 149 which is delimited by a skirt 150. This skirt 150 is parallel to the edge 110 of the channel-shaped cross-section, and is fixed to the web of that channel by means of an annulus 108 and situated on the same side of this web as are the sides of the channel.

On this annulus 108 is a stop 125 cooperating with a finger 126 carried by the opposite face of the disc 114, thus limiting the rotational actuating travel of the part 105*a*.

In this embodiment the neck 106, the obturator 105, and the applicator element 102 are coaxial cylindrical elements with a circular cross-section. The applicator element 102 is nestingly fixed to the upper portion 122 of the actuating part 105*a*.

In this embodiment the detachable container 142 is also cylindrical and coaxial with the cylindrical shell 140. It thus constitutes a refill for the device of the invention.

At its end closed by the bottom wall 141 the cylindrical shell 140 comprises a fitting 144 which is substantially coaxial with this shell and is directed towards the interior of the device. The internal wall of this fitting 144 comprises a thread cooperating with an external wall of the container 142 enabling the container 142 to be screwed down inside the cylindrical shell 140. The fitting 144 is joined to the shell 140 by an annulus 145.

The bottom 141 of the detachable container 142 has a circular zone 141*a* which projects from the container and bears on the annulus 145 when the container 142 is completely screwed down into the fitting 144. Moreover, this circular zone 141*a* comprises a sealing skirt 146 which cooperates with the internal wall of the fitting 144.

In order to facilitate gripping of the container 142, as well as its screwing and unscrewing, the bottom 141 of this container 142 comprises on its external face a small gripping bar 147 extending substantially diametrically.

The movable part 105*b* of the obturator 105 comprises means 148 for rupturing the cover 143 sealing the container 142. These means are for instance constituted by a star-shaped perforator 148.

A circular annular cutter 127 of the internal face of disc 114 of the actuating part 105*a* slides rotatably on the internal face of the skirt 150. The star-shaped perforator 148 is situated in this central opening 149 and is fixed on the skirt 150. At one axial end of this perforator 148 is the central stud 107 and at its other end it defines a tip 148*a* for tearing the covering 143.

When such a device is to be used, the user screws into the fitting 144 a container 142 containing a dose of the product to be applied.

Screwing the container 142 into the fitting 144, causes the frangible cover 143 to come into contact with the tip 148*a* of the star-shaped perforator 148 which, as the container 142 is further screwed down into the fitting 144, tears this cover. Removing the cap 128 which covers the applicator element 102 and bears on the reservoir 101, and causing the cutaneous covering to come into contact with the balls 104 and 104*a* which then constitute the lower portion of the device, allow the user to apply the dose of the product contained in the container 142 in an adjustable flow, thanks to the construction of the obturator 105.

The device in accordance with this variant can also comprise a stop at the base of the neck, a projection on the lower skirt of the actuating part, and a slot in the cap, which (as in the embodiment of FIGS. 1 to 4) all cooperate with each other when the obturator is in the closed position.

We claim:

1. In a device for manually massaging the cutaneous covering simultaneously with application thereto of a liquid or pasty product, said device comprising:

(a) reservoir means containing the product to be applied;

(b) applicator means including ball means, housing means holding said ball means, and means to said housing means defining at least one opening on the side nearer the reservoir means for admitting the product to be applied from the reservoir means to the internal volume of said housing means; and (c) obturator means between the reservoir means and said applicator means;

the improvement wherein:

(d) said obturator means comprises (da) a first movable obturator part, said first obturator part including a central strip and means defining at least one opening to allow the product to be applied to pass through said first obturator part, and (db) a second actuating obturator part, said second obturator part comprising a disc, means defining a central hole in said disc, and a skirt extending downwardly from said disc and surrounding at least said first obturator part;

(e) said applicator means includes means releasably fixing it to said second obturator part;

(f) said first and second obturator parts comprise cooperating means to ensure relative displacement between said first and second obturator parts to a first relative position in which said central stud closes said central hole and a second relative position in which the central hole is completely freed; and (g) said cooperating means of said first and second obturator portions are operative to pass in a continuous movement from said first relative position to said second relative position;

wherein the reservoir means comprise a detachable container; wherein said device includes a shell which has one end closed by a bottom integral with said detachable container; wherein there are rupturable cover means closing said detachable container to contain the product to be applied; wherein the other end of said shell has a free edge cooperating with the applicator means and the obturator means; and wherein the obturator means comprises means for rupturing said cover means.

2. A device according to claim 1, wherein said shell is a cylindrical body.

3. A device according to claim 2, wherein at its said end closed by said bottom integral with the detachable container, the cylindrical shell comprises fitting means which is substantially coaxial with said shell and is directed towards the interior of the device, wherein said fitting means has on its internal wall a thread, wherein said detachable container includes an external thread cooperating with said thread on said fitting means, and including an annulus joining said fitting to said cylindrical shell.

4. A device according to claim 1, wherein the means for rupturing the cover means are carried by the said first obturator part.

5. A device according to claim 1, wherein said means defining said opening comprises skirt means, said skirt means being integral with the periphery of said first obturator part.

6. A device according to claim 5, wherein the means for rupturing the cover means is carried by the said first obturator part, and wherein the means for rupturing the cover means is integral with said skirt means.

7. A device according to claim 6, wherein said means for rupturing the cover means comprise a star-shaped perforator having at one axial end said central stud and at the other axial end a perforating tip.

8. A device according to claim 3, wherein said bottom integral with said detachable container has a circular zone which projects therefrom and abuts said annulus when said container is completely screwed into the fitting means.

9. A device according to claim 8, wherein said circular zone comprises a sealing skirt cooperating with the internal wall of the annulus.

10. A refill constituted by said detachable container of the device according to claim 1, wherein said detachable container is cylindrical and comprises at one end an external thread adjacent said bottom, and at its other end said rupturable cover means.

* * * * *